US009656500B1

(12) United States Patent
Kobayashi et al.

(10) Patent No.: US 9,656,500 B1
(45) Date of Patent: May 23, 2017

(54) IMAGE RECORDING MEDIUM AND METHOD FOR PREPARING IMAGE RECORDING MEDIUM

(71) Applicant: FUJI XEROX CO., LTD., Tokyo (JP)

(72) Inventors: Tomoo Kobayashi, Kanagawa (JP); Kaoru Torikoshi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/093,036

(22) Filed: Apr. 7, 2016

(30) Foreign Application Priority Data

Oct. 28, 2015 (JP) ..... 2015-212178

(51) Int. Cl.

| | |
|---|---|
| ***B41M 5/50*** | (2006.01) |
| ***B41M 5/52*** | (2006.01) |
| ***G03G 15/16*** | (2006.01) |
| ***B41M 7/00*** | (2006.01) |

(52) U.S. Cl.
CPC ..... *B41M 5/502* (2013.01); *B41M 5/508* (2013.01); *B41M 5/52* (2013.01); *B41M 5/5272* (2013.01); *B41M 7/0054* (2013.01); *G03G 15/1625* (2013.01)

(58) Field of Classification Search
CPC ..... B41M 5/50; B41M 5/502; B41M 5/508; B41M 5/52; B41M 5/5272; B41M 7/0054
USPC ..... 428/195.1
See application file for complete search history.

(56) References Cited

U.S. PATENT DOCUMENTS

2005/0175819 A1 8/2005 Kobayashi et al.

FOREIGN PATENT DOCUMENTS

JP 4168846 B2 10/2008
JP 4525100 B2 8/2010

*Primary Examiner* — Bruce H Hess
(74) *Attorney, Agent, or Firm* — Oliff PLC

(57) ABSTRACT

An image recording medium includes an image supporting member that has a ruggedness on a surface and has a surface roughness Rz of 3 μm or more, an image receiving layer that includes a first thermoplastic resin having a glass transition temperature of 60° C. or more and a second thermoplastic resin having a glass transition temperature of 15° C. or less, and a transparent supporting member, in this order, wherein an image formed of an image forming material is provided between the image supporting member and the image receiving layer and a ruggedness corresponding to the ruggedness of the image supporting member is formed on an outermost surface of the image recording medium on a side of the transparent supporting member.

4 Claims, 3 Drawing Sheets

IMAGE RECORDING MEDIUM AND METHOD FOR PREPARING IMAGE RECORDING MEDIUM

CROSS-REFERENCE TO RELATED APPLICATIONS

This application is based on and claims priority under 35 USC 119 from Japanese Patent Application No. 2015-212178 filed Oct. 28, 2015.

BACKGROUND

1. Technical Field

The present invention relates to an image recording medium and a method for preparing an image recording medium.

2. Related Art

As a method for preparing an image recording medium by forming an image on an image supporting member through an electrophotographic method, a method for preparing an image recording medium by forming an image on an image receiving layer of an image transfer sheet through the electrophotographic method, and then transferring (laminating) the formed image onto the image supporting member which is a transfer medium is tested.

SUMMARY

According to an aspect of the invention, there is provided an image recording medium including:

an image supporting member that has a ruggedness on a surface and has a surface roughness Rz of 3 μm or more;

an image receiving layer that includes a first thermoplastic resin having a glass transition temperature of 60° C. or more and a second thermoplastic resin having a glass transition temperature of 15° C. or less; and a transparent supporting member, in this order, wherein an image formed of an image forming material is provided between the image supporting member and the image receiving layer, and a ruggedness corresponding to the ruggedness of the image supporting member is formed on an outermost surface of the image recording medium on a side of the transparent supporting member.

BRIEF DESCRIPTION OF THE DRAWINGS

Exemplary embodiments of the present invention will be described in detail based on the following figures, wherein.

DETAILED DESCRIPTION

Hereinafter, the exemplary embodiments of the invention will be described in detail.

Image Recording Medium and Preparing Method Thereof

The image recording medium in the exemplary embodiment includes an image supporting member having ruggedness on a surface; an image receiving layer which includes a first thermoplastic resin having a glass transition temperature of 60° C. or more and a second thermoplastic resin having a glass transition temperature of 15° C. or less; and a transparent supporting member, in this order, in which an image formed of an image forming material is provided between the image supporting member and the image receiving layer, and a ruggedness corresponding to the ruggedness of the image supporting member is formed on the outermost surface of the image recording medium on the side of the transparent supporting member.

Here, the expression "having ruggedness" means having a surface shape having differences in the height.

Figure 1:
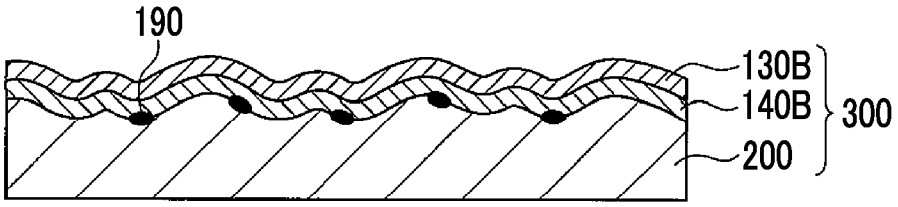
FIG. 1 is a schematic sectional view illustrating an example of an image recording medium in the exemplary embodiment.
Figure 4:
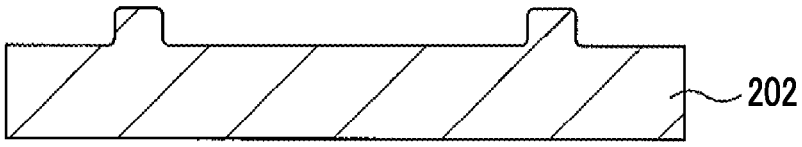
FIG. 4 is a schematic sectional view illustrating another example of an image supporting member used for an image recording medium in the exemplary embodiment.
Figure 5:
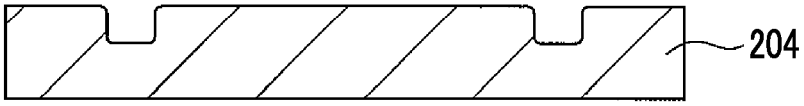
FIG. 5 is a schematic sectional view illustrating another example of an image supporting member used for an image recording medium in the exemplary embodiment.

Thus, examples of the image supporting member "having the ruggedness on the surface" include an aspect having a surface shape in which a concave portion and a convex portion are repeated in succession as an image supporting member 200 illustrated in FIG. 1, an aspect having a surface shape in which the convex portions are formed on a portion of the nearly smooth surface as an image supporting member 202 illustrated in FIG. 4, and an aspect having a surface shape in which concave portions are formed on a portion of the nearly smooth surface as an image supporting member 204 illustrated in FIG. 5. In addition, as fabric which is formed of mutually entangled fibers, an aspect having a shape in which a convex portion and a concave portion are always clearly divided, but has at least differences in the height on the surface may be also included in the example of the image supporting member.

Meanwhile, examples of the image supporting member having the ruggedness include an image supporting member in which surface roughness Rz is 1 μm or more, and as the surface roughness Rz becomes larger, the effect of the exemplary embodiment becomes improved. For this reason, in order to further improve the effect, the surface roughness Rz of the image supporting member is preferably 3 μm or more, is further preferably 5 μm or more, and is still further preferably 7 μm or more.

In addition, the expression "ruggedness corresponding to the ruggedness of the image supporting member" means that peak points of the concave portions and convex portions (that is, a top portion and a bottom portion on the surface having the difference in height) are present in the corresponding positions of the image recording medium in the thickness direction. In other words, the concave portions and convex portions are present at positions which overlap the ruggedness of the image supporting member in the thickness direction.

Note that the ruggedness of the image supporting member (hereinafter, also referred to as "supporting member ruggedness"), and the ruggedness of the outermost surface (hereinafter, also referred to as "surface ruggedness") on the transparent supporting member side of the image recording medium may have different amplitudes of ruggedness, that is, a difference in the height, as long as the peak points of the convex portions and concave portions are present at the same positions. Accordingly, in the image recording medium in the exemplary embodiment, if the surface ruggedness is formed on at a position where the peak points of the convex portion and the concave portion overlap the supporting member ruggedness in the thickness direction, the amplitude (the difference in the height) of the surface ruggedness may be the same as that of the supporting member ruggedness, or may be smaller and gentler than that of the supporting member ruggedness. In this regard, it is preferable that the reduction amount of the amplitude (the difference in the height) of the surface ruggedness is smaller than that of the amplitude (the difference in the height) of the supporting member ruggedness.

Here, an example of the image recording medium in the exemplary embodiment will be described with reference to the drawings. FIG. 1 is a schematic sectional view illustrating an example of the image recording medium in the exemplary embodiment.

An image recording medium 300 includes the image supporting member 200 having the ruggedness (the supporting member ruggedness) on the surface, an image receiving layer 140B, and a transparent supporting member 130B in this order, and the image supporting member 200 and the image receiving layer 140B has an image 190, which is formed of an image forming material, interposed therebetween. In addition, as illustrated in FIG. 1, the surface ruggedness corresponding to the supporting member ruggedness of the image supporting member 200 is formed on the outermost surface of the transparent supporting member 130B side, that is, the surface ruggedness is formed so as to overlap the supporting member ruggedness in the thickness direction.

In the related art, a method for preparing an image recording medium is attempted. The method is performed in such a manner that an image is formed on an image transfer sheet (hereinafter, also simply referred to as a "transfer sheet") through an image forming method such as an electrophotographic method, the formed image is transferred (laminated) onto the image supporting member which is a transfer medium, and thus the image recording medium is prepared. Specifically, the transfer sheet which includes an image receiving layer, a transparent supporting member, and a base material in this order, is used as the transfer sheet. The image is formed on the image receiving layer of the transfer sheet, then the image forming surface is superimposed on the image supporting member in a state of facing each other, heating and pressurizing are performed, and then the base material is peeled, thereby obtaining the image recording medium which is provided with the image supporting member, the image receiving layer, and the transparent supporting member, and in which the image supporting member and the image receiving layer has an image interposed therebetween.

Here, the image supporting member having the ruggedness on the surface thereof, for example, fabric, embossed paper, leather, or the like, has a visually and tactually distinctive texture by the ruggedness formed on the surface. When the image is transferred to the image supporting member (the transfer medium) having the ruggedness on a surface by using the image transfer sheet, the image recording medium having the texture by the ruggedness of the image supporting member is required to be prepared. However, in a case where the image recording medium is prepared by using the image transfer sheet, the image receiving layer and the transparent supporting member are transferred onto the image supporting member in a state of interposing the image therebetween, and thus the surface shape such as the shape of the transparent supporting member is reflected on the outermost surface of the transparent supporting member side, that is, the texture of the supporting member ruggedness is not reflected on the surface ruggedness, the amount of ruggedness of the surface is decreased with respect to the amount of ruggedness of the supporting member ruggedness. Accordingly, it is not easy that the texture by the ruggedness of the image supporting member is reflected on the outermost surface of the transparent supporting member side so as to exhibit the above-described distinct texture.

In contrast, in the image recording medium in the exemplary embodiment, the image receiving layer includes the first thermoplastic resin having the glass transition temperature of 60° C. or more and the second thermoplastic resin having the glass transition temperature of 15° C. or less. Thus, it is possible to obtain the image recording medium in which the amount of ruggedness (the surface ruggedness) on the outermost surface of the transparent supporting member side is prevented from being decreased with respect to the amount of ruggedness (the supporting member ruggedness) on the surface of the image supporting member.

The reason therefor may be considered that the image receiving layer contains the first and second thermoplastic resins which satisfy the above requirement, and thus when the image receiving layer is transferred (laminated), the image receiving layer is deformed in accordance with the ruggedness on the surface of the image supporting member, then the transparent supporting member is also deformed in accordance with the deformed image receiving layer, and thereby, the ruggedness corresponding to the ruggedness on the surface of the image supporting member is also formed on the outermost surface of the transparent supporting member side.

Image Supporting Member

Here, examples of the image supporting member having the ruggedness (that is, a surface shape having a difference in the height) on the surface, which is used in the exemplary embodiment include an image supporting member which is formed of a material having a convex portion such as a projection on the surface thereof, an image supporting member which is formed of a material having a concave portion such as a hole on the surface thereof, an image supporting member having a character, a pattern, a drawing, or the like which is formed into a concave shape or convex shape on the surface, and an image supporting member which is formed of mutually entangled fibrous materials.

More specifically, examples of the image supporting member include fabric, leather, paper on which at least one of a concave portion and a convex portion is formed, synthetic sponge which is prepared from a urethane resin, a melamine resin, synthetic rubber, or the like, a wooden board which uses a forest thinning material or the like, and a glass plate, a stone plate, a metal plate, or the like which is subjected to a surface treatment through sandblasting or chemical processing.

Examples of the fabric include a non-woven fabric, a natural fiber woven fabric, and a synthetic fiber woven fabric. Examples of commercially available fabric products include t-shirts, handkerchiefs, sheets, towels, place mats, book covers, canvas for painting, tote bags, bags for small items such as a pouch, umbrellas, and lamp shades.

Examples of the leather include synthetic leather and natural leather. Examples of commercially available leather products include bags for small items such as a wallet and a pouch, bags, clothing such as jackets and coats, trousers, and gloves, belts, footwear, cases for smart phones, and seats of, for example, a chair.

Examples of the paper on which at least one of the concave portion and the convex portion is formed include paper subjected to an embossing (crepe) process and paper subjected to a debossing process. Examples of commercially available paper products include MERMAID, KYANSON, WATSON, MUSE COTTON, LETHAC, CREPE PAPER, CROC GA, AREZAN FS, and JACQUARD.

Examples of the synthetic sponge which is prepared from the urethane resin, the melamine resin, or the synthetic rubber include various types of urethane foams (compression, semi-rigid, high elasticity, low elasticity, high resilience, low resilience, and the like), an ethylenevinyl acetate copolymer (EVA) sponge foam, soft rubber sponge, and chloroprene rubber sponge. Examples of commercially available synthetic sponge products include KANE FOAM, LUMIACE, NOAH FOAM, MARSHMALLOW TOUCH, and MELAMINE FOAM (GEKIOCHIKUN or the like).

Examples of the wooden board which uses a forest thinning material or the like include various types (cypress, cedar, pine, and the like) of single material plates, and various types of veneer plywood such as lauan. Examples of commercially available products of the wooden board which uses a forest thinning material or the like include various boxes, BASSWOOD VENEER, fancy plywood, wooden clock, fan, wooden boxes, coasters, bookmarks, straps, wooden plaque, display furniture, and photo frame.

Examples of commercially available products of the glass plate, the stone plate, and the metal plate which are subjected to the surface treatment through sandblasting or chemical processing include window glass, glass, a name plate, and a door plate.

In addition, the image supporting member having the ruggedness on the surface has a visually and tactually distinctive texture by ruggedness formed on the surface.

Image Recording Medium

Next, the image recording medium in the exemplary embodiment will be described with reference to the drawings. FIG. 1 is a schematic sectional view illustrating an example of the image recording medium in the exemplary embodiment, and FIG. 3 is a schematic sectional view illustrating a laminated member which is obtained by superimposing the image transfer sheet on the image supporting member in a superimposing step of a method for preparing the image recording medium according to the exemplary embodiment.

Figure 3:
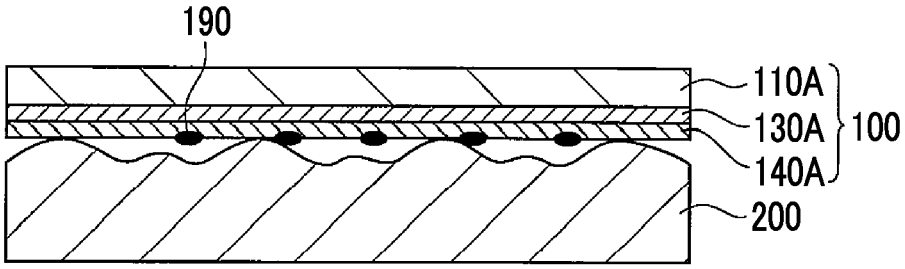
FIG. 3 is a schematic sectional view illustrating a laminated member which is obtained by superimposing the image transfer sheet on an image supporting member in a superimposing step of a method for preparing the image recording medium in the exemplary embodiment.

In FIG. 1 and FIG. 3, reference numerals 100, 200, and 300 respectively represent the transfer sheet, the image supporting member having the ruggedness on the surface, and the image recording medium.

FIG. 3 illustrates a state when the laminated member is formed in such a way of superimposing the transfer sheet 100 on the image supporting member 200 which is the transfer medium. Before the heating and pressurizing, the image 190 which is formed of the image forming material (toner) exists on an image receiving layer 140A side of the transfer sheet 100.

On the other hand, as illustrated in FIG. 1, after performing the heating and pressurizing step, and the peeling step (preferably, after further performing a pressurizing step), the image receiving layer 140B and the transparent supporting member 130B are deformed in accordance with the ruggedness (the supporting member ruggedness) on the surface of the image supporting member 200, and the surface ruggedness corresponding to the supporting member ruggedness is formed on the outermost surface of the transparent supporting member 130B side of the image recording medium 300. For this reason, it is possible to obtain the image recording medium in which the amount of the ruggedness (the surface ruggedness) on the outermost surface of the transparent supporting member 130B side is prevented from being decreased with respect to the amount of the ruggedness (the supporting member ruggedness) on the surface of the image supporting member 200. As a result, the distinctive texture of the image supporting member 200 is reflected on the outermost surface of the transparent supporting member 130B side of the image recording medium 300.

Meanwhile, the image 190 is in a state of being completely embedded into the surface of the image supporting member 200 and the image receiving layer 140B. Therefore, there is almost no level difference between the surface of the image supporting member 200 and a portion in which the image 190 is formed, and the prepared image recording medium 300 has the same texture as that of the image recording medium which is printed as it is, and thus the image 190 is not easily peeled.

In addition, after performing the peeling step, the transparent supporting member 130B which remains on the image supporting member 200 side functions as an overcoat layer in the image recording medium 300.

The peeled image recording medium 300 may be the image recording medium in the exemplary embodiment as it is; in a case where plural individual images are formed on the electrophotographic transfer sheet, plural image recording media having a predetermined size may be obtained by cutting each of the aforementioned individual images.

Method for Preparing Image Recording Medium

Here, a method for preparing an image recording medium in the exemplary embodiment will be described.

In the exemplary embodiment, as a transfer sheet, a transfer sheet which includes an image receiving layer, a transparent supporting member, and a base material in this order is used. In addition, in the transfer sheet, the image receiving layer includes a first thermoplastic resin having a glass transition temperature of 60° C. or more and a second thermoplastic resin having a glass transition temperature of 15° C. or less.

Further, the image recording medium is formed on the surface of the transfer sheet of the side on which the image receiving layer is provided through at least a step of forming an image which is formed of an image forming material (an image forming step), a step of forming a laminated member by superimposing the image transfer sheet on the image supporting member such that the surface side of the image transfer sheet on which the image is formed faces the supporting member (a superimposing step), a step of heating and pressurizing the laminated member to perform bonding (a heating and pressurizing step), and a step of peeling the base material from the image transfer sheet (a peeling step).

From the viewpoint that the surface ruggedness having higher accuracy corresponding to the supporting member ruggedness is formed on the outermost surface of the transparent supporting member side, and the distinctive texture of the image supporting member having the ruggedness on the surface is also reflected on the outermost surface of the transparent supporting member side, it is preferable that a step of pressurizing the laminated member from which the base material has been peeled off (a pressurizing step) is further provided after the peeling step.

Image Transfer Sheet

As a configuration of layers for the image transfer sheets used in the exemplary embodiment is not particularly limited as long as the configuration has the image receiving layer, the transparent supporting member, and the base material which satisfy the aforementioned configuration. For example, from the viewpoint that the base material is satisfactorily peeled when the image receiving layer and the transparent supporting member are transferred to the image supporting member, it is preferable that the transparent supporting member and the base material are formed with an adhesive layer interposed therebetween. In addition, the image receiving layer and the transparent supporting member may be formed with an adhesive layer interposed therebetween.

Hereinafter, a configuration example of the transfer sheet will be described in detail with reference to the drawings. However, the configuration of the transfer sheet which is employed in the exemplary embodiment is not limited to the configuration illustrated in the drawings as below.

Figure 2:
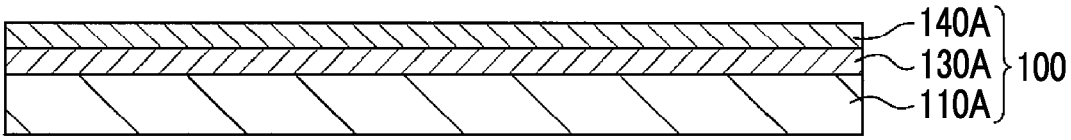
FIG. 2 is a schematic sectional view illustrating an example of an image transfer sheet used in the exemplary embodiment.

FIG. 2 is a schematic sectional view illustrating an example of the transfer sheet. The image transfer sheet illustrated in FIG. 2 is provided with a base material 110A, a transparent supporting member 130A, and the image receiving layer 140A. Note that, although not shown, it is preferable that the base material 110A and transparent supporting member 130A are stacked with the adhesive layer interposed therebetween.

Here, in the transfer sheet, the peeling strength between the transparent supporting member 130A and the base material 110A is set to be smaller than the peeling strength between the image receiving layer 140A and the transparent supporting member 130A. For this reason, in a case where one outermost surface layer and the other outermost surface layer (the base material 110A and the image receiving layer 140A in a case of the transfer sheet illustrated in FIG. 2) on the transfer sheet are peeled by pinching and pulling each of the end portions of the above layers, the transparent supporting member 130A and the base material 110A are separated and peeled off.

Particularly, in the exemplary embodiment, it is preferable that the adhesive layer is formed in an area interposed between the transparent supporting member 130A and the base material 110A as illustrated in FIG. 2, and in the embodiment, it is preferable that the peeling strength between the transparent supporting member 130A and the adhesive layer is smaller than the peeling strength between the image receiving layer 140A and the transparent supporting member 130A, and the peeling strength between the adhesive layer and the base material 110A. That is, in a case where one outermost surface layer and the other outermost surface layer (the base material 110A and the image receiving layer 140A in a case of the transfer sheet illustrated in FIG. 2) in the transfer sheet are peeled by pinching and pulling each of the end portions of the above layers, it is preferable that the image receiving layer 140A and the transparent supporting member 130A, and the adhesive layer and the base material 110A are separated and peeled off.

Further, in an interface on which peeling is performed, it is preferable that a layer forming one surface and a layer forming the other surface are both peeled off without partial transition.

Here, the peeling strength (N/cm) of each interface in each layer forming the transfer sheet is measured by using the following method.

First, a sample of the transfer sheet which is cut into a width of 25 mm is prepared, and then one outermost surface layer and the other outermost surface layer (the base material 110A and the image receiving layer 140A in a case of the transfer sheet illustrated in FIG. 2) on the sample are peeled by pinching and pulling each of the end portions of the above layers. At this time, the layers are peeled on the interface having the smallest peeling strength, and thus in the transfer sheet, the transparent supporting member 130A and the base material 110A are separated and peeled off.

In the aforementioned method, the layers are peeled by 6 mm from each of the end portions thereof on the interface having the smallest peeling strength, each of the end portions is pinched by using a chuck or a clamp of a tensile testing machine, a tensile speed is set to be 300 mm/min, and then the peeling strength (N/cm) having a peeing angle of 180 degrees is measured.

The measurement is performed based on JIS-X6305.

When the layers are completely peeled off on the interface having the smallest peeling strength by using the above-described method, the sample is divided into two samples. For example, in a case where peeling occurs on the interface between the transparent supporting member 130A and the adhesive layer on the transfer sheet illustrated in FIG. 2, the sample is divided into a sample including the base material 110A and the adhesive layer, and a sample including the image receiving layer 140A and the transparent supporting member 130A.

On one of the divided samples, one outermost surface layer and the other outermost surface layer (for example, the image receiving layer 140A and the transparent supporting member 130A if it is the sample including the image receiving layer 140A and the transparent supporting member 130A) are peeled by pinching and pulling each of the end portions of the above layers. At this time, if there is any interface on which the peeling occurs, the layers are peeled by 6 mm from each of the end portions thereof on the interface, each of the peeled end portions is pinched by using a chuck or a clamp of a tensile testing machine, a machine is operated with a tensile speed set to be 300 mm/min, and then the peeling strength (N/cm) having a peeing angle of 180 degrees is measured.

In addition, the same method is also applicable to the peeling of the other side of the divided sample, (for example, the sample including the base material 110A and the adhesive layer), if there is any interface on which the peeling occurs, the peeling strength of the interface is measured.

However, in a case of the transfer sheet as illustrated in FIG. 2, it is preferable that the base material 110A and the adhesive layer are adhered to each other, and the transparent supporting member 130A and the image receiving layer 140A are adhered to each other such that the peeling does not easily occur on the interface between the base material 110A and the adhesive layer, or the transparent supporting member 130A and the image receiving layer 140A. For this reason, it is considered that the value of the peeling strength of the interface on which the peeling does not occur becomes larger than the value of the peeling strength of the interface on which the measurement is performed by using the aforementioned method.

In addition, the measuring test of the peeling strength by using the above-described method may be performed after an image is formed on the image receiving layer of the transfer sheet, and the image receiving layer surface is laminated on the image supporting member so as to be the laminated member.

Note that, from the viewpoint that it is possible to efficiently prevent the transparent supporting member from being peeled from the image recording medium, the peeling strength between the image receiving layer 140A and the transparent supporting member 130A is preferably equal to or greater than 6 N/cm, is further preferably equal to or greater than 10 N/cm, and is still further preferably equal to or greater than 15 N/cm. In addition, an upper limit value of the peeling strength is not particularly limited, but it is preferably equal to or less than 100 N/cm.

In addition, from the viewpoint that the base material is satisfactorily peeled when the image receiving layer and the transparent supporting member are transferred to the image recording medium, the peeling strength between the transparent supporting member 130A and the base material 110A is preferably equal to or less than 1 N/cm, is further preferably equal to or less than 0.1 N/cm, and is still further preferably equal to or less than 0.03 N/cm. Further, a lower limit value of the peeling strength is not particularly limited as long as there exists an adhesive force to the extent that the peeling does not occur at the time of normal handling (for example, lifting by hands, setting on a machine, and transporting in a machine).

Also, from the viewpoint that in a case where the transfer sheet includes the adhesive layer as illustrated in FIG. 2, the base material and the adhesive layer are satisfactorily peeled at the time of transferring the image receiving layer and the transparent supporting member to the image recording medium, it is preferable that the peeling strength between the transparent supporting member 130A and the adhesive layer is in the above-described range.

Image Receiving Layer

Thermoplastic Resin

The image receiving layer in the exemplary embodiment includes at least a first thermoplastic resin having a glass transition temperature (Tg) of 60° C. or more and a second thermoplastic resin having a glass transition temperature (Tg) of 15° C. or less.

In a case where at least one of a requirement in which the first thermoplastic resin having Tg of 60° C. or more is not included, and a requirement in which the second thermoplastic resin having Tg of 15° C. or less is not included is satisfied, in the image recording medium, it is not possible to form the satisfactory surface ruggedness corresponding to the supporting member ruggedness on the outermost surface of the transparent supporting member side, and also it is not possible to prevent the amount of the surface ruggedness from being decreased with respect to the amount of the supporting member ruggedness. As a result, the distinctive texture of the image supporting member having the ruggedness on the surface is not easily reflected on the outermost surface of the transparent supporting member side.

Note that, the glass transition temperature (Tg) of the first thermoplastic resin is preferably 65° C. or more, and is further preferably 75° C. or more. Also, an upper limit value of the glass transition temperature is not particularly limited, but is preferably 120° C. or less.

On the other hand, the glass transition temperature (Tg) of the second thermoplastic resin is preferably 10° C. or less, and is further preferably 0° C. or less. In addition, the lower limit value is not particularly limited, but is preferably −40° C. or more.

Here, a method for measuring the glass transition temperature (Tg) of the thermoplastic resin will be described.

10 mg of a sample is put into a pan which is made of aluminum, is airtightly sealed, and then is measured at a temperature rising speed of 10° C./minute by using a differential scanning calorimeter (DSC-220, manufactured by Seiko Instruments Inc.). At this time, a temperature of intersection of an extended line of a base line which is equal to or lower than glass transition temperature and a tangential line indicating the maximum inclination in a transition portion is set to be the glass transition temperature (Tg).

In addition, the weight ratio (A:B) of the content (A) of the first thermoplastic resin to the content (B) of the second thermoplastic resin in the image receiving layer is preferably 20:80 to 85:15, is further preferably 25:75 to 75:25, and is still further preferably 40:60 to 50:50.

In addition, the total content (solid content ratio) of the first thermoplastic resin and the second thermoplastic resin in the image receiving layer is preferably in a range of 50% by weight to 100% by weight, is further preferably in a range of 60% by weight to 95% by weight, and is still further preferably in a range of 65% by weight to 90% by weight.

Next, specific examples of the thermoplastic resin will be described.

As the thermoplastic resin which is included in the image receiving layer, any thermoplastic resin may be used without particular limitation as long as the requirement of the glass transition temperature is satisfied in the first and second thermoplastic resins described above. Examples of the thermoplastic resin include a homopolymer or copolymer which is obtained by polymerizing one or two or more of styrenes such as styrene, vinyl styrene, and chlorostyrene; monoolefins such as ethylene, propylene, butylene, and isobutylene; vinyl esters such as vinyl acetate, vinyl propionate, vinyl benzoate, and vinyl butyrate; esters of α-unsaturated, monocarboxylic fatty acid such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and diene monomers such as isoprene and 2-chlorobutadiene.

Among these, particularly, styrenes and esters of α-unsaturated, monocarboxylic fatty acid are preferably used.

Further, as the thermoplastic resin which may be used in the exemplary embodiment, a polyester resin is preferably used from the viewpoint that the polyester resin is used for the image forming material, and thus it is possible to appropriately control the fixing properties of the image forming material onto the transfer sheet surface by containing a resin which is the same type as the polyester resin in the image receiving layer.

Examples of the above-described polyester resin also include a silicone-modified polyester resin, a urethane-modified polyester resin, and an acryl-modified polyester resin other than a typical polyester resin. In addition, these polyester resins may be used alone, or two or more kinds thereof may be used in combination.

The above-described polyester resin is prepared by the reaction between a polyvalent hydroxy compound and a polybasic carboxylic acid or a reactive acid derivative thereof. Examples of the polyvalent hydroxy compound forming polyester include diols such as ethylene glycol, diethylene glycol, triethylene glycol, 1,2-propylene glycol, 1,3-propylene glycol, neopentyl glycol, and 1,4-butanediol; bisphenol A alkylene oxide adducts such as hydrogenated bisphenol A, polyoxyethylenated bisphenol A, and polyoxypropylenated bisphenol A; and other divalent alcohols, and divalent phenols such as bisphenol A.

In addition, examples of the polybasic carboxylic acid include malonic acid, succinic acid, adipic acid, sebacic acid, an alkyl succinic acid, maleic acid, fumaric acid, mesaconic acid, citraconic acid, itaconic acid, glutaconic acid, cyclohexane dicarboxylic acid, phthalic acid (isophthalic acid, and terephthalic acid), and other divalent carboxylic acids, or reactive acid derivatives thereof such as an acid anhydride, alkyl ester, and an acid halide.

In addition to these divalent hydroxy compounds and a carboxylic acid, a polyvalent (tri- or higher valent) hydroxyl compound or a polybasic (tri- or higher valent) carboxylic acid may be included such that the obtained thermoplastic resin is formed into a non-linear form to the extent that tetrahydroxyfuran insolubles are not generated.

Among these, particularly, a linear saturated polyester resin is preferably used. The linear saturated polyester resin is obtained by polycondensation of phthalic acid as a divalent carboxylic acid with ethylene glycol and neopentyl glycol as a polyvalent hydroxy compound at a predetermined composition ratio. Regarding the aforementioned composition ratio, it is preferable that the polymerization is performed by mixing the substances at the following ratios: the mole ratio of terephthalic acid to isophthalic acid is 1:1, the mole ratio of ethylene glycol to neopentyl glycol is in a range of 7:3 to 1:9, and the mole ratio of a divalent carboxylic acid and a polyvalent hydroxy compound is 1:1.

In addition, in the above-described thermoplastic resin, the glass transition temperature (Tg) may be adjusted by a typical method. A method for adjustment for the polyester resin may be exemplified as follows. If a phthalic acid component is contained by 90% or more of the polybasic carboxylic acid component, a component of ethylene glycol or neopentyl glycol is contained by 60% or more of the polyvalent hydroxy compound, and then the polybasic carboxylic acid component and the polyvalent hydroxy compound are used for the synthesis, the polyester resin having high Tg of 60° C. or more may be easily obtained. In addition, if sebacic acid or adipic acid is contained by 20% or more of the polybasic carboxylic acid component, and then the polybasic carboxylic acid component and the polyvalent hydroxy compound are used for the synthesis, the polyester resin having low Tg of 15° C. or less may be easily obtained.

In addition, the image receiving layer in the exemplary embodiment contains at least two kinds of thermoplastic resins among the above-described thermoplastic resins, that is, the first thermoplastic resin having Tg of 60° C. or more and the second thermoplastic resin having Tg of 15° C. or less.

Other Compositions

Further, examples of the resin which forms the image receiving layer include a curable resin such as a heat-curable resin, a photo-curable resin, and an electron beam curable resin.

In addition, the image receiving layer may contain a release agent such as a natural wax, a synthetic wax, a releasable resin, a reactive silicone compound, and modified silicone oil.

Specific examples of the release agent include the natural wax such as a carnauba wax, a beeswax, a montan wax, a paraffin wax, and a microcrystalline wax; and the synthetic wax such as a low molecular weight polyethylene wax, a low molecular weight oxidized polyethylene wax, a low molecular weight polypropylene wax, a low molecular weight oxidized polypropylene wax, a higher fatty acid wax, a higher fatty acid ester wax, and a sasol wax. These may be used alone or two or more kinds thereof may be used in combination.

In addition, examples of the releasable resin include a silicone resin; a fluororesin; a modified silicone resin which is a modified product of the silicone resin and various kinds of resins, such as a polyester-modified silicone resin, a urethane-modified silicone resin, an acryl-modified silicone resin, a polyimide-modified silicone resin, an olefin-modified silicone resin, an ether-modified silicone resin, an alcohol-modified silicone resin, a fluorine-modified silicone resin, an amino-modified silicone resin, a mercapto-modified silicone resin, and a carboxy-modified silicone resin; a heat-curable silicone resin; and a photo-curable silicone resin.

Further, in the exemplary embodiment, a reactive silane compound and modified silicone oil may be mixed as the release agent.

These wax and releasable resin may coexist in a particle state or the like; however, it is preferable that the wax and the releasable resin are added into the thermoplastic resin, then are dispersed in the resin such that both are compatible with each other, and thus are used in a state of being mixed into the thermoplastic resin.

In addition, in the exemplary embodiment, it is preferable that a filler is used for the image receiving layer.

The filler which is used in the exemplary embodiment is not limited. However, in a case where the filler is formed of organic resin particles, specific examples thereof include a homopolymer or copolymer which is obtained by polymerizing one or more of styrenes such as styrene, vinyl styrene, and chlorostyrene; monoolefins such as ethylene, propylene, butylene, and isobutylene; vinyl esters such as vinyl acetate, vinyl propionate, vinyl benzoate, and butyric acidvinyl; esters of α-unsaturated, monocarboxylic fatty acid such as methyl acrylate, ethyl acrylate, butyl acrylate, acrylic acid-dodecyl, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone; and diene monomer such as isoprene and 2-chlorobutadiene.

Among these, styrenes, esters of α-unsaturated, monocarboxylic fatty acid, and the like are preferably used, and in a case where these thermoplastic resins are used as the filler, it is preferable that thermoplastic resins are coated with a solvent which does not dissolve these resins. Further preferably, a heat-curable resin having a crosslinking structure obtained by adding a crosslinking agent or the like to these heat melting resins, and fine particles of the heat-curable resin, photo-curable resin, and electron beam curable resin which are described above are preferably used.

In addition, in a case where the filler is formed of inorganic particles, specific examples thereof include mica, talc, silica, calcium carbonate, zinc white, halloysite clay, kaolin, hydrochloric magnesium carbonate, quartz powder, titanium dioxide, barium sulfate, calcium sulfate, and alumina.

The filler is typically formed into a spherical particle shape, but may be formed into a plate shape, a needle shape, and an irregular shape.

In addition, a volume average particle size of the filler is preferably in a range of 0.1 μm to 30 μm, and is preferably equal to or greater than 1.2 times the film thickness of the image receiving layer.

The weight ratio (filler:binding agent) of the filler to a binding agent (a resin component) in the image receiving layer of the image transfer sheet is preferably in a range of 0.01:100 to 15:100, and is further preferably in a range of 0.5:100 to 5:100.

As the filler, inorganic particles (for example, $SiO_2$, $Al_2O_3$, talc, and kaolin) other than the above-described inorganic particles and plastic powders in the form of beads (for example, cross-linked PMMA, polycarbonate, polyethylene terephthalate, and polystyrene) may be used in combination.

Transparent Supporting Member

Next, the transparent supporting member used in the exemplary embodiment will be described below.

As the transparent supporting member, a plastic film is representatively used. Among the plastic films, a translucent film which used as an OHP film is preferably used. Examples of the translucent film include a poly-acetate film, a cellulose triacetate film, a nylon film, a polyethylene terephthalate film, a polyethylene naphthalate film, a polycarbonate film, a polysulfone film, a polystyrene film, a polyphenylene sulfide film, a polyphenylene ether film, a cycloolefin film, a polypropylene film, a cellophane, and an acrylonitrile-butadiene-styrene (ABS) resin film.

Among these, particularly, the polyethylene naphthalate film, the polyethylene terephthalate film, and the polyphenylene sulfide film are preferably used from the viewpoint that when the image recording member is prepared therefrom, the surface ruggedness having higher accuracy corresponding to the supporting member ruggedness is formed on the outermost surface of the transparent supporting member side, and the distinctive texture of the image supporting member having the ruggedness on the surface is also reflected on the outermost surface of the transparent supporting member side.

The transparent supporting member used in the exemplary embodiment may be prepared by using any method, but is prepared by using a known method such as a co-extrusion method and a binding method.

Meanwhile, the transparent supporting member is typically prepared in such a manner that after a co-extrusion step, in a longitudinal stretching step, a film is stretched between two or more rolls which have different circumferential speed such that the film is adjusted to have a desired film thickness, and thus is wound. In a case of biaxial stretching, the film which is subjected to the above step is introduced to a tenter as it is, and then is stretched in a range of 2.5 times to 5 times in the width direction. At this time, a stretching temperature is preferably in a range of 100° C. to 200° C.

A biaxially stretched film obtained as described above is subjected to heat treatment as necessary. The heat treatment is preferably performed in the tenter, and particularly, when the heat treatment is performed on the film while the film is softly stretched in the vertical and horizontal directions, the film having low thermal shrinkage may be obtained. As the transparent supporting member, particularly, the biaxially stretched film is preferably used.

It is further preferable that one side of the transparent supporting member is subjected to releasing treatment.

The releasing treatment typically means that a releasable material is subjected to surface treatment. The releasable material is not particularly limited; however, a silicon material is preferably used. The silicon material is formed of a condensate resin containing at least a silane composition, or is formed of a mixed composition of the condensate material and a colloidal silica dispersion. In addition, it is further preferable that the silicon material contains an organic resin.

As the silane composition, an organic silicon compound is specifically exemplified, and examples of the organic silicon compound include a silane compound, a fluorine-containing silane compound, and an isocyanate silane compound, and these compounds forma resin composition through the condensation reaction.

Examples of the silane compound include alkoxysilanes such as $Si(OCH_3)_4$, $CH_3Si(OCH_3)_3$, $HSi(OCH_3)_3$, $(CH_3)_2Si(OCH_3)_2$, $CH_3SiH(OCH_3)_2$, $C_6H_5Si(OCH_3)_3$, $Si(OC_2H_5)_4$, $CH_2Si(OC_2H_5)_3$, $(CH_3)_2Si(OC_2H_5)_2$, $H_2Si(OC_2H_5)_2$, $C_6H_5Si(OC_2H_5)_3$, $(CH_3)_2CHCH_2Si(OCH_3)_3$, $CH_3\ (CH_3)_{11}Si(OC_2H_5)_3$, $CH_3\ (CH_2)_{15}Si(OC_2H_5)_3$, and $CH_3(CH_2)_{17}Si(OC_2H_5)_3$; silazanes such as $(CH_3)_3SiNHSi(CH_3)_3$; special silylating agents such as $((CH_3)SiNH)_2CO_3$ and tert-$C_4H_9(CH_3)_2SiCl$; a silane coupling agent; a silane compound such as $HSC_3H_6Si(OCH_3)_3$; and hydrolyzate and partial condensate thereof.

Examples of the silane coupling agent include vinyl silanes such as vinyl tris(β-methoxyethoxy) silane, vinyl triethoxy silane, and vinyl trimethoxy silane; acryl silanes such as γ-methacryloxypropyl trimethoxy silane; epoxy silanes such as β-(3,4-epoxycyclohexyl)ethyl trimethoxy silane, and γ-glycidoxypropyl methyl diethoxy silane; and amino silanes such as N-β-(aminoethyl)-γ-aminopropyl methyl dimethoxy silane, γ-aminopropyl triethoxy silane, and N-phenyl-γ-aminopropyl trimethoxy silane.

Examples of the fluorine-containing silane compound include a fluorine-containing silane compound such as $CF_3(CH_2)_2Si(OCH_3)_3$, $C_6F_{13}C_2H_4Si(OCH_3)_3$, $C_7F_{15}CONH(CH_2)_3Si(OC_2H_5)_3$, $C_8F_{17}C_2H_4Si(OCH_3)_3$, $C_8F_{17}C_2H_4SiCH_3\ (OCH_3)_2$, $C_8F_{17}C_2H_4Si(ON{=}C(CH_3)(C_2H_5))_3$, $C_9F_{19}C_2H_4Si(OCH_3)_3$, $C_9F_{19}C_2H_4Si(NCO)_{31}(NCO)_3SiC_2H_4C_6F_{12}C_2H_4Si(NCO)_3$, $C_9F_{19}C_2H_4Si(C_2H_5)(OCH_3)_2$, $(CH_3O)_3SiC_2H_4C_8F_{16}C_2H_4Si(OCH_3)_3$, and $(CH_3O)_2(CH_3)SiC_9F_{18}C_2H_4Si(CH_3)(OCH_3)_2$; and a silane compound such as hydrolyzate and partial condensate thereof.

Examples of the isocyanate silane compounds include $(CH_3)_3SiNCO$, $(CH_3)_2Si(NCO)_2$, $CH_3Si(NCO)_3$, vinyl silyltriisocyanate, $C_6H_5Si(NCO)_3$, $Si(NCO)_4$, $C_2H_5OSi(NCO)_3$, $C_8H_{17}Si(NCO)_3$, $C_{18}H_{37}Si(NCO)_3$, and $(NCO)_3SiC_2H_4\ (NCO)_3$.

Examples of the condensate resin of the silane composition in the exemplary embodiment include a curable silicone resin such as a heat-curable (a condensation type and an addition type) silicone resin and a photo-curable silicone resin. Specific examples are as follows.

Among the above-described heat-curable silicone resins, examples of the condensation-type curable silicone resin include a curable silicone resin which is synthesized by setting polysiloxane such as polydimethyl siloxane having a silanol group at a tip end thereof as a base polymer, mixing polymethyl hydrogen siloxane or the like as a crosslinking agent into the base polymer, and then thermally condensating the mixture in the presence of a metal salt of an organic acid such as an organic tin catalyst or amines; a curable silicone resin which is synthesized by causing a reaction of polydiorganosiloxane having a reactive functional group such as a hydroxyl group and an alkoxy group at a tip end thereof; and a polysiloxane resin which is synthesized by condensating silanol obtained by hydrolyzing tri or higher functional chlorosilane or a mixture of tri or higher functional chlorosilane and the monofunctional or bifunctional chlorosilane.

Meanwhile, the condensation type is classified into a solution type and an emulsion type in terms of the formation thereof, which are preferably used.

Among the heat-curable silicone resins, examples of the addition-type curable silicone resin include a curable silicone resin which is synthesized by setting polysiloxane such as polydimethyl siloxane having a vinyl group as a base polymer, mixing polydimethyl hydrogen siloxane as a crosslinking agent into the base polymer, and then causing a reaction and curing of the mixture in the presence of the platinum catalyst.

Meanwhile, the addition type is classified into a solvent type, an emulsion type, and a solvent-free type in terms of the formation thereof, which are preferably used.

Preferable examples of the heat-curable silicone resin obtained by the condensation type curing or the addition type curing include a pure silicone resin, a silicone alkyd resin, a silicone epoxy resin, a silicone polyester resin, a silicone acrylic resin, a silicone phenolic resin, a silicone urethane resin, and a silicone melamine resin.

Examples of the photo-curable silicone resin include a curable silicone resin which is synthesized by using a photo-cationic catalyst and a curable silicone resin which is synthesized by using a radical curing mechanism. In addition, it is preferable to use a modified silicone resin obtained by causing a photo-curable reaction of a low molecular weight polysiloxane having a hydroxyl group which is bonded to a silicon atom, an alkoxy group, or the like with an alkyd resin, a polyester resin, an epoxy resin, an acrylic resin, a phenolic resin, a polyurethane resin, or a melamine resin. These may be used alone, or two or more kinds thereof may be used in combination.

Adhesive Layer

The transfer sheet may be formed of the transparent supporting member and the base material described below with an adhesive layer interposed therebetween.

The "adhesive layer" means a layer which functions as an adhesive for physically bonding transparent supporting member and the base material until a pre-step of a step of forming an image on the transfer sheet, and then transferring the image onto the image supporting member, and has a function of releasing the image from the transparent supporting member in a step of transferring the image which is laminated and cooled.

Note that, as the adhesive layer, a substance which is formed of a material of a semi solid (that is, it has a viscosity) under the environment of the normal temperature (22° C.) and the normal pressure (50%), is not deformed after being bonded, and is capable of bonding other layers without solidifying the adhesive layer may be used, and a substance may be formed of a material of a solid (that is, it does not have a viscosity) under the environment of the normal temperature (22° C.) and the normal pressure (50%).

Examples of a material of the adhesive layer include rubber such as natural rubber, styrene-butadiene-rubber (SBR), and butyl rubber. Examples of a material of the adhesive layer further include a synthetic resin such as an acryl resin, a silicon resin, and a hot-melt resin. Here, the synthetic resin which may adjust the peeling strength by using an additive or the like is preferably used, and among the synthetic resins, the silicon resin is further preferably used in terms of stability over time, heat resistance, and the like. However, since the compatibility with the transparent supporting member is to be considered, the material of the adhesive layer is not limited to the above description.

Base Material

Next, the base material used for the transfer sheet will be described below.

The base material is not particularly limited; however, a plastic film is representatively used, for example. Preferable examples thereof includes a poly-acetate film, a cellulose triacetate film, a nylon film, a polyester film, a polycarbonate film, a polysulfone film, a polystyrene film, a polyphenylene sulfide film, a polyphenylene ether film, a cycloolefin film, a polypropylene film, a polyimide film, a cellophane, and an acrylonitrile-butadiene-styrene (ABS) resin film, which may be white or transparent.

In addition, a material in the form of sheet such as paper, metal, plastic, and ceramic is preferably used as the base material.

Physical Properties of Image Transfer Sheet

In addition, in the transfer sheet used in the exemplary embodiment, surface resistivity of the image receiving layer provided on the base material is preferably in a range of $1.0\times10^{8}\Omega$ to $3.2\times10^{13}\Omega$, and the surface resistivity is further preferably in a range of $1.0\times10^{9}\Omega$ to $1.0\times10^{12}\Omega$.

In the transfer sheet in the exemplary embodiment, a difference of the surface resistivity between the front surface and a rear surface under the temperature of 23° C. and 55% RH is preferably within 4-digit, and is further preferably within 3-digit.

Note that, under the environment of the temperature of 23° C. and 55% RH, the surface resistivity is measured by using a circular electrode (for example, "HR PROBE" of HIRESTA IP manufactured by Mitsubishi Chemical Analytech Co., Ltd.) based on JIS K6911.

In a case where the surface resistivity of the image receiving layer is controlled to be in a range of $1.0\times10^{8}\Omega$ to $3.2\times10^{13}\Omega$, it is preferable that a charge-controlling agent is contained in the image receiving layer. Examples of the charge-controlling agent include a polymeric conductive material, a surfactant, and a conductive metal oxide particle.

In addition, it is preferable that a matting agent is added into the image receiving layer or a coating layer other than the image receiving layer provided on the surface of the base material.

Examples of the conductive metal oxide particle include ZnO, TiO, $TiO_2$, $SnO_2$, $Al_2O_3$, $In_2O_3$, SiO, $SiO_2$, MgO, BaO, and $MoO_3$. These may be used alone or may be used in combination. In addition, as the metal oxide, a substance which further contains different elements is preferably used. For example, a substance obtained by causing ZnO to contain (be doped with) Al, In, and the like, a substance obtained by causing TiO to contain (be doped with) Nb, Ta, and the like, and a substance obtained by causing $SnO_2$ to contain (be doped with) Sb, Nb, a halogen element, and the like are preferable. Among these, $SnO_2$ which is doped with Sb is particularly preferable since it shows less change over time in the conductivity thereof, thereby having high stability.

Examples of the resin having lubricity used for the matting agent include polyolefin such as polyethylene; and a fluororesin such as polyvinyl fluoride, polyvinylidene fluoride, and polytetrafluoroethylene (TEFLON (registered trade mark)).

In addition, in a case where the image receiving layer is provided only on one surface of the base material, the surface resistance value of the base material is controlled at the time of preparing a film which corresponds to the base material in a such a manner that a surfactant, a polymeric conductive material, a conductive particle, and the like are added into the resin, the surface of the film is coated with the surfactant, a metal thin film is subjected to vapor deposition, or the appropriate amount of the surfactants or the like is added to the adhesive or the like.

Examples of the surfactant to be used include a cationic surfactant such as polyamines, ammonium salts, sulfonium salts, phosphonium salts, and betaine amphoteric salts, an anionic surfactant such as alkyl phosphates, and a nonionic surfactant such as fatty acid ester. Among these surfactants, in a case where the surfactant is used for electrophotography, it is preferable to use the cationic surfactant which has a large interaction with negatively chargeable toner for electrophotography in recent years.

In addition, among the above-described cationic surfactants, quaternary ammonium salts are preferable. As the quaternary ammonium salts, a compound which is representatively expressed by the following Formula (I) is preferably used.

Formula (I)

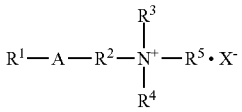

In Formula (I), $R^1$ represents an alkyl group, an alkenyl group or an alkynyl group, each having carbon atoms in a range of 6 to 22, and $R^2$ represents a divalent group obtained by removing one hydrogen atom from an alkyl group, an alkenyl group or an alkynyl group, each having carbon atoms in a range of 1 to 6. $R^3$, $R^4$, and $R^5$ which may be the same as each other or may be different from each other represent an aliphatic group, an aromatic group, or a heterocyclic group. The aliphatic group represents a straight chain, branched, or cyclic alkyl group, a straight chain, branched, or cyclic alkenyl group, or a straight chain, branched, or cyclic alkynyl group. The aromatic group represents a benzene monocyclic ring, or a condensed polycyclic aryl group. These groups may include a substituent such as a hydroxyl group. A represents an amide bond, an ether bond, an ester bond, or a phenylene group, but may be removed. $X^-$ represents a halogen element, a sulfate ion, or a nitrate ion, and the sulfate ion or the nitrate ion may include a substituent.

Method for Preparing Image Transfer Sheet

Here, the method for preparing the image transfer sheet will be described with an example of the image transfer sheet illustrated in FIG. 2 in the exemplary embodiment. The image transfer sheet as illustrated in FIG. 2 is provided with a base material 110A, a transparent supporting member 130A, and an image receiving layer 140A, in which the base material 110A is laminated on the transparent supporting member 130A with an adhesive layer (not shown) interposed therebetween.

In the image transfer sheet, for example, a fixed image of a reverse image (a mirror image) is formed on the surface of the base material 110A having transparency such that the image on the image supporting member becomes a forward image (a normal image) when an image is transferred to the image supporting member.

In a case where the transfer sheet includes an adhesive layer, the transfer sheet is formed in such a manner that after the surface of the base material 110A is coated with an adhesive which corresponds to the adhesive layer, the aforementioned film or the like which forms the transparent supporting member 130A is bonded to the surface of the base material 110A, and then the surface of the stacked layer is coated with a coating layer which corresponds to the image receiving layer 140A.

In addition, the transfer sheet also may be formed in such a manner that after the surface of the base material 110A is coated with the adhesive which corresponds to the adhesive layer, and the surface of the aforementioned film or the like which forms the transparent supporting member 130A is coated with the coating layer which corresponds to the image receiving layer 140A, the surface opposite to the image receiving layer 140A of the transparent supporting member 130A and the surface of the adhesive layer side of the base material 110A are bonded to each other.

The coating layer of the image receiving layer 140A is formed in such a manner that the respective components such as a wax or a resin, and particles are mixed with each other by using an organic solvent or water, a coating liquid is prepared by dispersing the mixture by using a device such as an ultrasonic apparatus, a wave rotor, an attritor, and a sand mill, and then the surface of the transparent supporting member 130A is coated with the prepared coating liquid as it is.

Examples of a method for coating or impregnating the surface include normally used methods such as a blade coating method, a wire bar coating method, a spray coating method, a dipping coating method, a bead coating method, an air knife coating method, a curtain coating method, and a roll coating method.

Regarding the aforementioned coating, in a case where the image transfer sheet includes the coating layer on, for example, both surfaces of the base material 110A, one of the both surfaces may be coated first, or both surfaces are coated at the same time.

At the time of forming the coating layer on the surface of the base material 110A, the drying may be performed by wind, and the thermal drying is also adaptable for easy drying. Examples of the drying method include normally used methods such as a method for putting in an oven, a method for passing through an oven, and a method for contacting a heating roll.

In the practical usage, a static friction coefficient of the surface of the transfer sheet is preferably 2 or less, and is further preferably 1 or less. In addition, a dynamic friction coefficient of the surface of the transfer sheet is preferably in a range of 0.2 to 1, and is further preferably in a range of 0.3 to 0.65.

For example, in the exemplary embodiment, a toner image is formed on the surface of the image transfer sheet as an image. In a case where the toner image is formed, it is preferable that the formed toner image is fixed such that the temperature of the surface of the image transfer sheet (an image forming surface) is equal to or lower than a toner melting temperature. In consideration of the normal toner melting temperature, the fixing is performed such that the surface temperature of the image transfer sheet is preferably 130° C. or less, and further preferably 110° C. or less.

In addition, in the exemplary embodiment, a toner image which is formed by using an electrophotographic image forming device has been described as an image which is formed on the surface of the image transfer sheet; the image is not limited thereto. For example, the image may be formed by using ink.

The film thickness of the image receiving layer 140A which is formed as described above is preferably in a range of 5 μm to 25 μm, and further preferably in a range of 7 μm to 20 μm.

Here, a numerical value of the film thickness of each layer described in the specification is measured by using DIGIMATIC INDICATOR ID-H0530 manufactured by Mitutoyo Corporation.

Preparation of Image Recording Medium

Next, a method for preparing the image recording medium in the exemplary embodiment will be described below.

In the exemplary embodiment, as the transfer sheet, a transfer sheet which includes an image receiving layer, a transparent supporting member, and a base material in this order is used, and in the transfer sheet, the image receiving layer includes a first thermoplastic resin having a glass transition temperature of 60° C. or more and a second thermoplastic resin having a glass transition temperature of 15° C. or less.

Further, the image recording medium is formed on the surface of the transfer sheet on the side on which the image receiving layer is formed through at least one of a step of forming an image which is formed of an image forming material (an image forming step), a step of forming a laminated member by superimposing the image transfer sheet on the image supporting member such that the surface side of the image transfer sheet on which the image is formed faces the supporting member (a superimposing step), a step of heating and pressurizing the laminated member to perform bonding (a heating and pressurizing step), and a step of peeling the base material in the image transfer sheet (a peeling step).

In addition, it is preferable that after the peeling step, a step of pressurizing the laminated member, from which the base material is peeled off (a pressurizing step), is further provided.

Note that, in the image forming step, it is preferable that an image is formed on the transfer sheet by using the electrophotographic image forming apparatus.

On the other hand, each of the superimposing step, the heating and pressurizing step, the peeling step, and the pressurizing step which is performed as necessary may be manually performed, or may be performed by using a laminating device for automatically performing a series of steps.

In addition, each of the steps may be performed by using an apparatus for preparing an image recording medium in which the image forming device and the laminating device are integrally provided.

Figure 6:
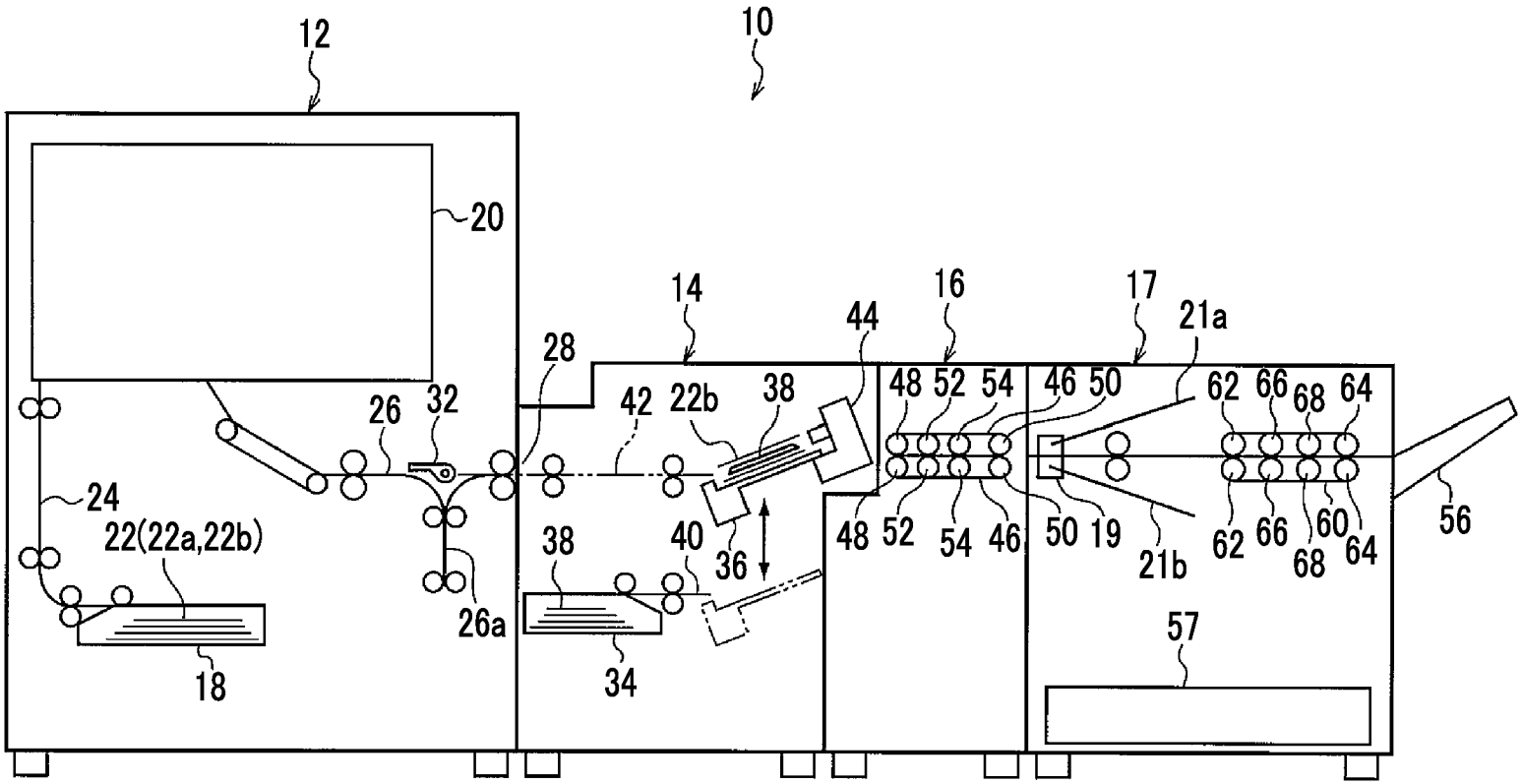
FIG. 6 is a schematic view illustrating a configuration example of an apparatus for preparing an image recording medium in the exemplary embodiment.

Here, the method for preparing the image recording medium in the exemplary embodiment will be described with reference to the drawings. FIG. 6 is a schematic view illustrating a configuration of the apparatus for preparing an image recording medium in the exemplary embodiment.

As illustrated in FIG. 6, an apparatus 10 for preparing an image recording medium includes an image forming device 12, a gathering device 14 (a positioning unit), a laminating device (a heating and pressurizing unit), and a peeling and re-pressurizing device 17 (a peeling and re-pressurizing unit).

The image forming device 12 is provided with, for example, a transfer sheet storing unit 18, an image forming unit 20, a feeding path 24 for transporting a transfer sheet 22 from the transfer sheet storing unit 18 to the image forming unit 20, and a feeding path 26 for transporting the transfer sheet 22 from the image forming unit 20 to the discharging port 28. Other components will not be described.

The transfer sheet storing unit 18 stores the transfer sheet 22 and is provided with a pick-up roll and a paper supplying roll which are provided in a normal paper supplying device, and the paper supplying roll or the like is rotated at a predetermined timing, and then the transfer sheet 22 is transported to the image forming unit 20.

Although not shown, the image forming unit 20 is configured of a well-known electrophotographic device which includes a latent image holding member, a charger for charging the latent image holding member, a latent image forming device for forming a latent image on the charged latent image holding member, a developing device for obtaining a toner image by developing the latent image with a developing agent at least containing toner, a transferring device for transferring the developed toner image to the transfer sheet 22, and a fixing unit for heating and pressurizing the toner image which is transferred to the transfer sheet 22.

The feeding paths 24 and 26 are formed of plural of pairs of rolls including pairs of driving rolls and guides (not shown), and the feeding path 26 is provided with an inversion path **26*a* for inverting a transporting direction of the transfer sheet 22 by 180°. A cam 32 for changing a guide direction of the transfer sheet 22 is provided in a branched portion between the feeding path 26 and the inversion path 26*a*. When the transfer sheet 22 is reciprocated in inversion path 26*a* and returned to the feeding path 26, the transporting direction of the transfer sheet 22 is inverted by 180° and the transfer sheet 22** is transported in a state where a front surface and a rear surface are inverted.

The gathering device 14 is formed of a storing portion 34 of an image supporting member 38 (an image supporting member having the ruggedness on the surface (for example, embossed paper)) which is a transfer medium, a gathering unit 36 (a positioning portion), a feeding path 40 for supplying the image supporting member 38 to the gathering unit 36 from the image supporting member storing portion 34, and a feeding path 42 for supplying the transfer sheet 22 which is discharged from the discharging port 28 of the image forming device 12 to the gathering unit 36.

A discharging portion of the feeding path 40 for supplying the image supporting member 38 to the gathering unit 36, and a discharging portion of the feeding path 42 for supplying the transfer sheet 22 to the gathering unit 36 are positioned to be lined up in the vertical direction.

The feeding paths 40 and 42 may be formed of a plate member and a feeding roll which is provided to transport the transfer sheet 22 or the image supporting member 38 on the surface, or may be formed of a rotary belt-shaped transporting member. The feeding roll or belt is rotated at the timing of discharging the transfer sheet 22 from the image forming device 12, or discharging the image supporting member 38, and then the transfer sheet 22 or the image supporting member 38 is transported to the gathering unit 36.

The image supporting member storing portion 34 (the image supporting member storing portion) stores the image supporting member 38, and is provided with a pick-up roll and a paper supplying roll which are provided in a normal paper supplying device, and after the gathering unit 36 is moved to the position of the discharging port of the image supporting member storing portion 34, the paper supplying roll or the like is rotated such that the image supporting member 38 is transported to the gathering unit 36.

The gathering unit 36 is configured in such a way that a portion of an end portion of the gathering unit 36 is connected to an outer wall of the belt which is vertically (upper and lower sides in FIG. 6) supported, and thus is moved up and down in accordance with the rotation of the belt such that the image supporting member 38 and the transfer sheet 22 are supplied to the gathering unit 36 from each of the discharging portion of the feeding path 40 and the discharging portion of the feeding path 42. However, a well-known unit of moving up and down, for example, a motor driving method may be applied without being limited to the above unit for moving up and down. In addition, the gathering unit 36 is provided with a positioning unit (not shown) for positioning the end portions of the image supporting member 38 and the transfer sheet 22 which are stacked on each other to be lined up.

In the gathering unit 36, a temporary fixing unit 44 for temporarily fixing a laminated member obtained by stacking two transfer sheets 22 via the image supporting member 38 is provided. For example, the temporary fixing unit 44 is formed of a pair of metallic protruding parts so as to be heated by a heater or the like, the end portion of the laminated member is pinched by the pair of heated protruding parts, and thus the end portion of the laminated member is thermally welded and temporarily fixed.

A temporary fixing method is not limited to the method by a pair of protruding parts as long as thermal welding is employed. For example, other existing methods, that is, a method for causing heated members in the form of needles to pass through a sheet in the vertical direction, or pinching a sheet by members mounted with an ultrasonic vibrator and then welding the sheet using heat caused by ultrasonic vibration may be employed. In addition, units for mechanically restraining the each other' movements without using the heat, that is, needles of a stapler, or a gripper which may move with the sheet along the transporting path.

In a case where the temporary fixing unit 44 is provided on the feeding path on which the laminated member is supplied to the laminating device 16 from the gathering unit 36, it is necessary that the temporary fixing unit 44 is disposed at the end portion of the gathering unit 36 only at the time of the temporary fixing, and is configured to be retractable from the feeding path at any other time than that.

Examples of the laminating device 16 include a belt-nip type device which is formed of a pair of belts 46. Each of the belts 46 is supported by a heating and pressurizing roll 48 and a supporting roll 50, and also includes pressurizing rolls 52 and 54.

A pressurizing method in the laminating device 16 is not particularly limited, and various conventionally known laminating methods and laminating devices are preferably employed. For example, the laminated member is compressed by using a normal laminating method and the laminating device, or a heat pressing method and a heat pressing device. The aforementioned methods are performed in such a manner that the laminated member is inserted into the nip portion of a pair of heat rolls or the like, and then both transfer sheet and image supporting member of the laminated member are heat-melted so as to be welded to each other.

The peeling and re-pressurizing device 17 is formed of, for example, an air ejecting nozzle 19, guides 21*a* and 21*b*, and a pressurizing belt 60, and a receiver 56 is provided on the downstream side of the transporting passage of the image supporting member.

The peeling and re-pressurizing device 17 includes a belt-nip type pressurizing belt 60 which is positioned on the downstream side of the air ejecting nozzle 19 and the guides 21*a* and 21*b*, and on the upstream side of the receiver 56. The belt-nip type pressurizing belt 60 is a pressurizing member for pressurizing the laminated member from which the base material is peeled off, and in which a pair of belts come in contact with each other so as to form a nip. Each of belts in the pressurizing belt 60 is supported by a heating and pressurizing roll 62 and a supporting roll 64, and includes pressurizing rolls 66 and 68. In addition, at least the laminated member is pressurized by using the pressurizing member, but it is preferable that the laminated member is further heated. The pressurizing belt 60 is provided with the heating and pressurizing roll 62.

In the pressurizing member, time for pressurizing the laminated member (time for passing through the nip in the pressurizing belt 60) is preferably in a range of 0.5 minutes to 8 minutes, and is further preferably in a range of 1 minute to 5 minutes. In addition, in a case of performing the heating in addition to the pressurizing, for example, the heating is preferably performed in a range of 110° C. to 180° C., and is further preferably performed in a range of 120° C. to 160° C.

However, as the pressurizing method in the pressurizing member, it is possible to employ a conventionally known pressurizing method without being limited to the aforementioned method. For example, a pressurizing method, which is performed by causing the laminated member to pass through a nip portion by the pair of pressurizing rolls, a pressurizing method, which is performed by causing flat surfaces of a pair of pressurizing members (for example, two plate-shaped pressurizing members) having at least one flat surface to interpose the laminated member between the flat surfaces facing each other, may be employed.

Next, an operation of an apparatus 10 for preparing the image recording medium will be described.

First, in the image forming device 12, a fixed image is formed in such a manner that among the transfer sheets 22, a first transfer sheet 22*a* stacked on the rear surface (the lower side in FIG. 6) of the image supporting member 38 is supplied to the image forming unit 20 from the transfer sheet storing unit 18 via the feeding path 24, and a toner image is transferred to and fixed on the upper surface (the upper side in FIG. 6) of the first transfer sheet 22*a* by using the electrophotographic method (image forming step). At this time, the fixed image is formed on the upper surface of the first transfer sheet 22*a*, and thus the first transfer sheet 22*a* is transported as it is to the discharging port 28 via the feeding path 26, and then is transferred to the gathering device 14.

In addition, in the gathering device 14, the first transfer sheet 22*a* is supplied to the gathering unit 36 via the feeding path 42 of the gathering device 14. Here, the first transfer sheet 22*a* which is discharged from the discharging portion of the feeding path 42 is gravitationally supplied to the gathering unit 36 by such that the image surface faces upper surface.

Next, the gathering unit 36 is moved up and down to the discharging portion of the feeding path 40, and the image supporting member 38 is supplied to the gathering unit 36 from the image supporting member storing portion 34 via the feeding path 40. Here, the image supporting member 38 which is discharged from the discharging portion of the feeding path 40 is gravitationally supplied to the gathering unit 36, and then is stacked on the first transfer sheet 22*a*.

Next, in the image forming device 12, a fixed image is formed in such a manner that a second transfer sheet 22*b* which is stacked on the front surface (the upper side in FIG. 6) of the image supporting member 38 is supplied to the image forming unit 20 from the transfer sheet storing unit 18 via the feeding path 24, and a toner image is transferred to and fixed on the upper surface (the upper side in FIG. 6) of the second transfer sheet 22*b* by using the electrophotographic method (image forming step). The fixed image is formed on the upper surface of the second transfer sheet 22*b*, and thus the second transfer sheet 22*b* is firstly transferred to the inversion path 26*a* by passing through the feeding path 26, then returns to the feeding path 26 so as to be transported to the discharging port 28, and then to the gathering device 14.

At this time, in the branched portion between the feeding path 26 and the inversion path 26*a*, when the cam 32 is driven such that the tip end thereof overlaps the feeding path 26, the transporting direction of the second transfer sheet 22*b* which has reached a portion of the tip end of the cam 32 is changed and the second transfer sheet 22*b* is guided and transported to the inversion path 26*a*. In addition, after the second transfer sheet 22*b* approaches the inversion path 26*a*, the second transfer sheet 22*b* is reciprocated on the inversion path 26*a* by inverting a driving roll (not shown), and then is returned to the feeding path 26. For this reason, regarding the second transfer sheet 22*b* which returns to the feeding path 26, the transporting direction thereof is inverted by 180°, the front surface and the rear surface are inverted and the second transfer sheet 22*b* is transported such that the image surface faces the lower side (the lower side in FIG. 6).

In addition, in the gathering device 14, the second transfer sheet 22*b* is supplied to the gathering unit 36 via the feeding path 42 of the gathering device 14. Here, the second transfer sheet 22*b* which is discharged from the discharging portion of the feeding path 42 is gravitationally supplied to the gathering unit 36 such that the image surface faces the lower surface, and then is stacked on the image supporting member 38.

In this way, the first transfer sheet 22*a* with the upward image surface, the image supporting member 38, and the second transfer sheet 22*b* with the downward image surface are supplied in this order and stacked on each other in the gathering unit 36 (positioning step). This laminated member is obtained in such a manner that the image surfaces of the first transfer sheet 22*a* and the second transfer sheet 22*b* face each other and then are stacked on each other via the image supporting member 38.

Subsequently, end portions of the first transfer sheet 22*a*, the image supporting member 38, and the second transfer sheet 22*b* on the gathering unit 36 are positioned to be lined up by using the positioning unit (not shown), then the end portion of the laminated member is temporarily fixed by the temporary fixing unit 44, and thereafter, the laminated member is transported to the laminating device 16. Meanwhile, the positioning is performed by setting the size of the transfer sheet 22 and the image supporting member 38 to the same as each other, and then lining up the end portions of the laminated member.

Next, in the laminating device 16, the laminated member which is formed of the first transfer sheet 22*a*, the image supporting member 38, and the second transfer sheet 22*b* is subjected to heating and pressurizing treatment by passing through the nip between a pair of belts 46, and then the image supporting member 38 is heated and compressed by the first transfer sheet 22*a* and the second transfer sheet 22*b* (heating and pressurizing step).

Thereafter, the heated and compressed laminated member is transported to the peeling and re-pressurizing device 17.

When the tip end portion of the laminated member approaches the air ejecting nozzle 19, compressed air is injected from the nozzle. The end portions of the base materials of the respective first transfer sheet 22*a* and second transfer sheet 22*b* is lifted from the image supporting member 38 which is obtained by pressurizing the image receiving layer and the transparent supporting member, and the tip ends of the guides 21*a* and 21*b* enter an area which is interposed between the base material of the first transfer sheet 22*a* and the transparent supporting member, and an area which is interposed between the base material of the second transfer sheet 22*b* and the transparent supporting member. In addition, as the laminated member is transported, the base materials of two transfer sheets are transported in the direction of being separated from the image supporting member 38 along the guides 21*a* and 21*b*, and then peeled off from the image supporting member 38.

Next, the laminated member from which the base material is peeled off is subjected to the pressurizing (preferably, heating and pressurizing) by the pressurizing belt 60 as the pressurizing member. Note that the surface of the belt in the pressurizing belt 60 is preferably subjected to the emboss processing in various shapes.

The image supporting member 38 obtained by pressurizing the image receiving layer and the transparent supporting member is discharged to the receiver 56, and a recorded image supporting member may be obtained. Here, in a case where plural individual images are formed on the image supporting member, the images are cut for each image so as to obtain the image supporting member in a defined size.

Thereafter, the base material of the first transfer sheet 22*a* and the base material of the second transfer sheet 22*b* are discharged to a transfer sheet receiver 57 via a path (not shown).

As described above, in the apparatus of preparing the image recording medium in the exemplary embodiment, the image recording medium is obtained in such a manner that the image is formed on one surface of each of two transfer sheets 22 by the electrophotographic method, the image surfaces of the two transfer sheets 22 are caused to face each other via the image supporting member 38 and are heated and compressed, and then the base material is peeled off from the transfer sheet.

In addition, in the image forming device 12, the inversion path 26*a* is provided in the middle of the feeding path 26 for transporting the discharging port 28 and the transfer sheet 22 from the image forming unit 20, and among the transfer sheets 22, the first transfer sheet 22*a* which is supplied to the lower side of the gathering unit 36 does not pass through the inversion path 26*a*, but the second transfer sheet 22*b* which is supplied to the upper side pass through the inversion path 26*a* so as to be transported in a state where the front surface and the rear surface are inverted. As in such a state, if the front surface and the rear surface of the transfer sheet 22 are selectively inverted, it is possible to continuously perform the positioning, and thus it is possible to perform printing on an image supporting member further efficiently.

In addition, in the method for preparing the image recording medium in the exemplary embodiment, as a method for forming an image on the surface of the image receiving layer, a well-known image forming method such as a method for forming an ink image by using ink is employed other than a method for forming a toner image by using an electrophotographic image forming method.

The superimposing of the transfer sheet on the image supporting member may be performed by positioning the transfer sheet and the image supporting member to be lined up by hands, and may be performed in such a manner that after the image is formed on the transfer sheet, the transfer sheet and the image supporting member are sequentially discharged to the gathering unit or the like such that the transfer sheet and the image supporting member are positioned to be lined up.

The pressurizing method in the heating and pressurizing step is not particularly limited, and various conventionally known laminating methods and laminating devices are preferably employed. Among these, a heat pressing method for laminating sheets by applying heat is preferably used. For example, the pressurizing may be performed by using a normal laminating method and laminating device, which are performed in such manner that the laminated member of the transfer sheet and the image supporting member is inserted into a pressure welding portion (nip portion) of a pair of heat rolls capable of heating the laminated member, and then the transfer sheet and the image supporting member are heat-melted to a certain degree so as to be welded to each other.

In the laminated member which is heated and compressed, after the image forming material is cooled and solidified, the base material of the electrophotographic transfer sheet is peeled off from the image supporting member, the image is recorded by transferring the image forming material to the image supporting member, and thereby the image recording medium of the exemplary embodiment is prepared.

At the time of cooling and solidifying the image forming material, the specific temperature is equal to or lower than a softening point at which the toner hardens, for example, is equal to or lower than the glass transition temperature of the image forming material, and is preferably in a range of 22° C. (normal temperature) to 50° C. In addition, the condition for peeling the transfer sheet from the image supporting member is not particularly limited, but it is preferable to slowly peel the transfer sheet from the image supporting member by pinching the end surface of the transfer sheet.

Image Supporting Member

In the exemplary embodiment, the image supporting member having the ruggedness on the surface is used as the image supporting member. Meanwhile, examples of the image supporting member having the ruggedness on the surface include those described above.

EXAMPLE

Hereinafter, the present invention will be further specifically described with reference to Examples. However, the exemplary embodiment is not limited thereto. In addition, in Examples and Comparative Examples described below, "part" and "%" mean "part by weight" and "% by weight, respectively".

Example 1

An electrophotographic image transfer sheet (transfer sheet 1) is prepared by using the following methods. Hereinafter, the preparing method will be described for each step.

Preparation of Resistance Controlling Layer Solution Aa-1

A resistance controlling layer solution Aa-1 for controlling the surface resistivity is prepared in such a manner that 0.5 parts by weight of spherical cross-linked methyl polymethacrylate particles (SSX-102: manufactured by Sekisui Plastics Co., Ltd., volume average particle size: 2 μm) as a filler and 200 parts by weight of ethanol are mixed into 100 parts by weight of acrylic polymer solution (ELECOND QO-101: manufactured by Soken Chemical & Engineering Co., Ltd, solid content concentration: 50%) which is a cationic antistatic agent, and the mixture is sufficiently stirred.

Preparation of image-receiving layer coating solution Ba-1

An image-receiving layer coating solution Ba-1 is prepared in such a manner that 9 parts by weight of polyester resin (VYLON 802: manufactured by TOYOBO CO., LTD, Tg: 60° C.) and 11 parts by weight of polyester resin (VYLON 500: manufactured by TOYOBO CO., LTD, Tg: 4° C.), 1 part by weight of surfactant (ELEGAN 264 WAX: manufactured by NOF CORPORATION) as a thermoplastic resin, 3 parts by weight of spherical cross-linked methyl polymethacrylate particles (SSX-115: manufactured by Sekisui Plastics Co., Ltd., volume average particle size: 15 μm) as a filler are added into a solvent which is 50 parts by weight of methyl ethyl ketone, and are sufficiently stirred.

Preparation of Adhesive-Layer Coating Solution Ca-1

An adhesive-layer coating solution Ca-1 is prepared in such a manner that 20 parts by weight of silicone adhesive (XR37-B9204: manufactured by Momentive Performance Materials Inc., solid content concentration: 60%), and 0.2 parts by weight of the cross-linking agent thereof (XC93-B6144: manufactured by Momentive Performance Materials Inc.) are diluted with 20 parts by weight of toluene, and are sufficiently stirred.

Preparation of Transfer Sheet a1

An adhesive layer having a film thickness of 7 μm is formed in such a manner that one surface side of biaxially oriented PET (LUMILAR S10: manufactured by Toray Industries, Inc., thickness: 75 μm) as a base material is coated with the above-described adhesive layer coating solution Ca-1 by using a wire bar, and the coated surface is dried at 120° C. for 2 minutes.

An adhesive layer surface of the base material on which the above-described adhesive layer is formed is bonded to one surface side of biaxially oriented PET (LUMILAR F53: manufactured by Toray Industries, Inc., thickness: 6 μm) as a transparent supporting member under the conditions of normal temperature (22° C.), the speed of bonding (0.2 m/min), and cylinder pressure (588 KPa).

A resistance controlling layer having a film thickness 0.5 μm is formed in such a manner that an untreated surface of the base material of the bonded sheet is coated with the above-described resistance controlling layer solution Aa-1 by using a wire bar, and the coated surface is dried at 120° C. for one minute.

Next, a transfer sheet a1 is prepared in such a manner that an untreated surface of the transparent supporting member of the bonded sheet is coated with the above-described image-receiving layer coating solution Ba-1 by using a wire bar, the coated surface is dried at 120° C. for one minute so as to form a receiving layer having a film thickness of 10 μm, and thereafter, the receiving layer is cut into an A4 size (210 mm×297 mm) sheet.

Image Formation

A color mirror image including a solid image pattern is formed on the surface of the image receiving layer of the above-described transfer sheet a1 (the image is not formed) by using an image forming device (color copying machine DOCUCOLOR 1450GA: manufactured by Fuji Xerox Connected to, Ltd).

Preparation of Image Recording Medium a1

Subsequently, white canvas (thickness level: 11) which is cut into the A4 size is used as the image supporting member having the ruggedness on the surface, and the image is transferred from the transfer sheet a1 on which the above-described image is formed to the image supporting member by using the following methods.

In the apparatus 10 for preparing the image recording medium as illustrated in FIG. 6, a device including only the laminating device 16 and the peeling and re-pressurizing device 17 is prepared. In addition, a belt in which the fiber having the surface roughness Rz of 10 μm is impregnated with rubber is used as the pressurizing belt 60 in the peeling and re-pressurizing device 17.

The image surface of the transfer sheet a1 and the canvas (thickness level: 11) are put together into the device including the laminating device 16 and the peeling and re-pressurizing device 17, and the image is transferred to the canvas (thickness level: 11) together with the biaxially oriented PET (transparent supporting member, thickness: 6 μm). In this way, the image recording medium a1 of the canvas (thickness level: 11, image supporting member) on which a toner image is formed on the surface, and is protected by the biaxially oriented PET (transparent supporting member) is prepared.

Evaluation of Image Recording Medium 1: Surface Roughness

Before and after the transferring, surface roughness of the image recording medium a1 to which the image is transferred is measured with respect to the surface of the image supporting member (before transferring) and the surface of the transparent supporting member (after transferring). Specifically, the measurement is performed for the surface roughness Rz defined based on JIS-B0601 (1994) and the average interval of the ruggedness of Sm by using SURFCOM 130A manufactured by Tokyo Seimitsu Co., Ltd.

On the surface of the image supporting member before transferring the image and the surface of the transparent supporting member after transferring the image, if variation of the average interval of the ruggedness of Sm is small, for example, equal to or lower than 10%, and the surface roughness Rz of the transparent supporting member after transferring the image is equal to or greater than 3 μm, it is determined that it is possible to follow the surface ruggedness before and after transferring the image, and thus obtaining satisfactory appearance.

Evaluation of Image Recording Medium 2: Scratch Resistance

The scratch resistance of the image surface is confirmed in such a manner that a nylon scrubbing brush (SCOTCH-BRITE: manufactured by 3M Company, with abrasive particles: 230 mm×150 mm) is placed on the image surface of the image recording medium a1, further an 500 g of Al plate which has the same size (230 mm×150 mm) as that of the nylon scrubbing brush is placed thereon, and the image surface is reciprocated 10 times in the horizontal direction.

It is confirmed that problems are not found such as scratches on the surface, and adverse effects on the image.

Evaluation of Image Recording Medium 3: Heat Resistance

The heat resistance of the image is confirmed in such a manner that a stainless steel kettle containing one liter of boiling water is placed on the image surface of the image recording medium a1 for 5 minutes.

It is confirmed that problems are not found such as adverse effects on the surface and image.

The above obtained results are indicated in Table 1.

Example 2

Plywood which has a thickness of 2 mm and is cut into the A4 size is prepared as the image supporting member having the ruggedness on the surface. By bonding the image surface of the transfer sheet a1 of Example 1 and the plywood, an image recording medium a2 of the plywood in which the toner image is formed on the surface, and is protected by the biaxially oriented PET (transparent supporting member) is prepared in the same way as that used in Example 1, and then the same evaluation as that of Example 1 is performed.

The above obtained results are indicated in Table 1.

Example 3

Synthetic leather which is cut into the A4 size with a thickness of 0.9 mm, and is embossed in a lizard pattern (STH LIZARD No. 9: manufactured by GINGA KOBO) is prepared as the image supporting member having the ruggedness on the surface. The image surface of the transfer sheet a1 of Example 1 and the lizard-patterned surface of the synthetic leather are bonded and laminated by using a commercially available laminator (LPD3226: manufactured by FUJIPLA Inc.) under the conditions of the temperature (140° C.) and the speed (0.6 m/min). Thereafter, the biaxially oriented PET as the base material is peeled off together with the adhesive layer, then the laminated member including the toner image between the peeled biaxially oriented PET (transparent supporting member) and the synthetic leather (the image supporting member) is inserted to the laminator again. In this way, an image recording medium a3 of the synthetic leather having the lizard pattern on which a toner image is formed on the surface, and is protected by the biaxially oriented PET (transparent supporting member) is prepared. Then, the same evaluation as that of Example 1 is performed.

The above obtained results are indicated in Table 1.

Example 4

Synthetic leather which is cut into the A4 size with a thickness of 0.6 mm, and is embossed in a stone pattern (SUNNY LEATHER #4101: manufactured by Takashima shoji Co., Ltd.) is prepared as the image supporting member having the ruggedness on the surface. By bonding the image surface of the transfer sheet a1 of Example 1 and the stone-patterned synthetic leather, the image recording medium a4 of the stone-patterned synthetic leather in which the toner image is formed on the surface, and is protected by the biaxially oriented PET (transparent supporting member) is prepared in the same way as that used in Example 3, and then the same evaluation as that of Example 1 is performed.

The above obtained results are indicated in Table 1.

Comparative Example 1

An OHP film (CG3500 for color laser printer; manufactured by 3M Company, A4 size) is prepared, and an image is formed on the OHP film by using a method described in Image formation of Example 1. Then, the image forming surface of the OHP film is coated with a spray adhesive (SPRAY ADHESIVE 99: manufactured by 3M Company, high-strength), the adhesive-coated surface and the canvas (thickness level: 11, white, A4 size) are bonded to each other, and similarly to Example 1, the bonded surfaces pass through the laminating device 16, and then, similarly to Example 1, are re-pressurized by the pressurizing belt 60 without being peeled from each other. In this way, an image recording medium b1 of the canvas (thickness level: 11, image supporting member) on which a toner image is formed on the surface, and is protected by the OHP film is prepared in the same way as that used in Example 1, and then the same evaluation as that of Example 1 is performed.

As a result, the measuring result of the average interval of the ruggedness of Sm after transferring the image is "no measured value", in other words, there is no ruggedness. In addition, Rz is 0.1 μm, which means that the ruggedness is not formed on the surface and the OHP film is merely attached on the surface, and thus it is not possible to follow the ruggedness state of the textile (canvas, thickness level: 11).

Meanwhile, regarding the scratch resistance and heat resistance, the problems such as scratches and image changes are not found.

Comparative Example 2

A transparent film sheet (color laser printer PET; manufactured by Quick Art, thickness: 50 μm, A4 size) is prepared, and an image is formed on the image-receiving surface of the transparent film sheet by using a method described in Image formation of Example 1. Then, similarly to Example 2, the adhesive surface on the side opposite to the side on which the image is formed is boned to the plywood. Subsequently, similarly to Example 1, the bonded surfaces pass through the laminating device 16 (laminating step), and, are re-pressurized by the pressurizing belt 60 (re-pressurizing step) without being peeled from each other similarly to Example 1. In this way, an image recording medium b2 of the plywood on which the transparent film sheet is attached on the surface, and a toner image is formed on the outermost surface of the transparent film sheet is prepared. Thereafter, the same evaluation as that of Example 1 is performed.

As a result, the image is formed on the outer side, and thus the offset transition of the image occurs in the laminating step and re-pressurizing step, thereby preparing the image recording medium having a low image density. Further, the measuring result of the average interval of the ruggedness of Sm after transferring the image is "no measured value", in other words, there is no ruggedness. In addition, Rz is 0.4 μm, which means that the ruggedness is not formed on the surface and the transparent film sheet is merely attached on the surface, and thus it is not possible to follow the ruggedness state of the plywood.

Meanwhile, regarding evaluation of the scratch resistance and heat resistance, a portion of the remaining image is further peeled off.

Comparative Example 3

A urethane transfer sheet for textile (color laser printer EA-CR manufactured by Quick Art, A4 size, a sheet on which a thin layer of a urethane resin is attached on the surface of release paper) is prepared, and an image is formed on the surface of the image receiving layer (urethane resin) of the urethane transfer sheet for textile by using a method described in Image formation of Example 1. Then, similar to Example 3, the lizard-patterned surface of the synthetic leather (STH LIZARD No. 9: manufactured by GINGA KOBO) and the image surface of the urethane transfer sheet for textile are bonded to each other. Then, the bonded surfaces are laminated by using a commercially available laminator (LPD3226: manufactured by FUJIPLA Inc.) under the conditions of the temperature (140° C.) and the speed (0.6 m/min). Thereafter, the release paper is peeled off from the urethane transfer sheet for textile.

Here, when confirming the surface properties of the outermost surface (urethane resin surface), the surface properties (ruggedness) of the urethane resin surface of the urethane transfer sheet for textile are confirmed, whereas the lizard pattern (ruggedness) of the synthetic leather having the lizard pattern is not confirmed. Next, when the sheet is inserted into the laminator again, the sheet winds around a roll of the laminator. Thus, the re-pressurizing is performed by lowering the temperature to 100° C. in the laminator, and thereby an image recording medium b3 of the synthetic leather having the lizard pattern on which a toner image is formed on the surface, and is protected by the thin layer of the urethane resin is prepared. Thereafter, the same evaluation as that of Example 1 is performed.

As a result, it is confirmed that the lizard pattern (ruggedness) of the synthetic leather having the lizard pattern is formed on the outermost surface (urethane resin surface), and thus it is possible to follow the ruggedness of the lizard pattern of the synthetic leather.

However, in the scratch resistance evaluation, scratches due to the scraping are seen in a portion of the surface. In addition, in the heat resistance evaluation, the urethane resin and the toner image are partially transitioned on the bottom of the kettle, and the image is transitioned to the kettle, and thereby the image of the image recording medium b3 becomes partially defective, which causes a decrease in the image density.

TABLE 1

| | | Surface roughness | | | | | | | |
|---|---|---|---|---|---|---|---|---|---|
| | | | Average interval of ruggedness Sm [μm] | | | | | | |
| | | Image supporting member | Before transferring | After transferring | Variation before and after transferring | Rz [μm] after transferring | Scratch resistance/Heat resistance | | Total evaluation |
| | | | | | | | Scratch | Image defective | |
| Example | 1 | Canvas (thickness level: 11) | 230 | 245 | 6.5% | 5.5 | None | None | Totally excellent (A) |
| | 2 | Plywood | 333 | 344 | 3.3% | 4.3 | None | None | Totally excellent (A) |
| | 3 | Lizard-patterned synthetic leather | 485 | 530 | 9.3% | 9.4 | None | None | Totally excellent (A) |
| | 4 | Stone-patterned synthetic leather | 407 | 427 | 4.9% | 5.3 | None | None | Totally excellent (A) |
| Comparative Example | 1 | Canvas (thickness level: 11) | 230 | No measured value | — | 0.1 | None | None | Ruggedness is not formed on textile (B) |

TABLE 1-continued

| | Image supporting member | Surface roughness: Average interval of ruggedness Sm [μm]: Before transferring | After transferring | Variation before and after transferring | Rz [μm] after transferring | Scratch resistance/Heat resistance: Scratch | Image defective | Total evaluation |
|---|---|---|---|---|---|---|---|---|
| 2 | Plywood | 333 | No measured value | | 0.4 | None | Image is peeled off in scratch resistance evaluation and heat resistance evaluation (B) | Ruggedness is not formed on textile, none of scratch resistance and heat resistance (B) |
| 3 | Lizard-patterned synthetic leather | 485 | 505 | 4.1% | 10.5 | Partially scratched, and wrinkled in scratch resistance evaluation (B) | image is peeled off in scratch resistance evaluation (B) | None of scratch resistance and heat resistance (B) |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image recording medium comprising:

an image supporting member that has a ruggedness on a surface and has a surface roughness Rz of 3 μm or more;

an image receiving layer that includes a first thermoplastic resin having a glass transition temperature of 60° C. or more and a second thermoplastic resin having a glass transition temperature of 15° C. or less; and a transparent supporting member, in this order, wherein an image formed of an image forming material is provided between the image supporting member and the image receiving layer, and a ruggedness corresponding to the ruggedness of the image supporting member is formed on an outermost surface of the image recording medium on a side of the transparent supporting member.

2. The image recording medium according to claim 1, wherein the first thermoplastic resin and the second thermoplastic resin each includes a polyester resin.

3. A method for preparing an image recording medium, comprising:

forming an image formed of an image forming material on a surface of an image transfer sheet including an image receiving layer that includes a first thermoplastic resin having a glass transition temperature of 60° C. or more and a second thermoplastic resin having a glass transition temperature of 15° C. or less, a transparent supporting member, and a base material, in this order, on the side on which the image receiving layer is provided;

superimposing the image transfer sheet on an image supporting member such that a surface on which the image is formed faces the image supporting member, to thereby form a laminated member;

heating and pressurizing the laminated member to perform bonding;

peeling the base material from the image transfer sheet; and pressurizing the laminated member from which the base material is peeled.

4. The method for preparing an image recording medium, according to claim 3, wherein the first thermoplastic resin and the second thermoplastic resin includes a polyester resin.

* * * * *